US008763887B2

(12) United States Patent
Nieto

(10) Patent No.: US 8,763,887 B2
(45) Date of Patent: Jul. 1, 2014

(54) OCTAGONAL CONTAINER FOR FOOD, ESPECIALLY TOSTADAS

(75) Inventor: Ismael Palacios Nieto, Nuevo Leon (MX)

(73) Assignee: Grupo Fiesta Charra, S.A. DE C.V., Monterrey, Nuevo Leon (MX)

( * ) Notice: Subject to any disclaimer, the term of this patent is extended or adjusted under 35 U.S.C. 154(b) by 114 days.

(21) Appl. No.: 13/064,820

(22) Filed: Apr. 19, 2011

(65) Prior Publication Data

US 2012/0228366 A1 Sep. 13, 2012

(30) Foreign Application Priority Data

Mar. 11, 2011 (MX) ..... MX/e/2011/016982

(51) Int. Cl.
*B65D 5/10* (2006.01)

(52) U.S. Cl.
USPC ..... 229/109; 229/128; 229/138; 229/155

(58) Field of Classification Search
USPC ..... 229/109, 116.1, 128, 155, 156, 185, 229/137, 138
See application file for complete search history.

(56) References Cited

U.S. PATENT DOCUMENTS

| | | | | | |
|---|---|---|---|---|---|
| 901,695 | A * | 10/1908 | Davis | 229/109 |
| 2,047,804 | A * | 7/1936 | Shapiro | 229/109 |
| 2,091,291 | A * | 8/1937 | Ringler | 229/109 |
| 2,160,488 | A * | 5/1939 | Ringler | 229/138 |
| 3,232,480 | A * | 2/1966 | Stanley | 229/128 |
| 3,526,352 | A * | 9/1970 | Swett | 229/128 |
| 3,768,720 | A * | 10/1973 | Bundy | 229/155 |
| 3,799,425 | A * | 3/1974 | Fanter | 229/116.1 |
| 4,185,767 | A * | 1/1980 | Sykora et al. | 229/138 |
| 4,442,624 | A * | 4/1984 | Browne | 43/107 |
| D280,703 | S * | 9/1985 | Strobe | D9/430 |
| 4,712,725 | A * | 12/1987 | Moore | 229/128 |
| 4,850,528 | A * | 7/1989 | Hanus | 229/155 |
| 5,558,272 | A * | 9/1996 | Magister | 229/109 |
| 7,681,784 | B2 * | 3/2010 | Lang | 229/138 |
| 2010/0206943 | A1 | 8/2010 | Nieto | |
| 2011/0095074 | A1 * | 4/2011 | Stephens | 229/116.1 |

FOREIGN PATENT DOCUMENTS

| | | | | |
|---|---|---|---|---|
| EP | 357300 | A1 * | 3/1990 | 229/128 |

* cited by examiner

*Primary Examiner* — Gary Elkins
(74) *Attorney, Agent, or Firm* — Breiner & Breiner, L.L.C.

(57) ABSTRACT

An octagonal container for food, such as suitable for keeping or packaging tostadas, manufactured from a carton blank, is formed of eight sections or sides which includes at one end a flap with adhesion thereon that is joined to an opposite flap. The container also has edges located on top and bottom sides that are folded and joined towards the center of the container. The top part of the container is structured to form what appears to be a flower upon closure which provides a very attractive characteristic for the consumer. The container also has a practical, new, and easy closing system, so that when opening the container, it is only necessary to pull the opening flaps outward. To close the container, it is only necessary to press such flaps to the center and inwards and the container will be kept sealed. When closing the container, a "sinking" is formed in the top part of the container which acts as a cushion so that the product in the container is kept in good condition.

2 Claims, 7 Drawing Sheets

OCTAGONAL CONTAINER FOR FOOD, ESPECIALLY TOSTADAS

FIELD OF INVENTION

An octagonal container for food, particularly tostadas, is described for protecting the food from breakage while also providing ready access to the food. The container is configured from a packaging blank.

Priority of Mexican Patent Application No. MX/E/2011/016982 is claimed under 35 U.S.C. §119 and the disclosure thereof is hereby incorporated by reference.

BACKGROUND OF THE INVENTION

Today, there are a diverse number of containers to keep and preserve food that is exhibited to the public for sale. Containers for tostadas are generally plastic bags that have the disadvantage that most of the time the products stored in the bag break. Consequently, the product can not be sold resulting in losses for the producer. Furthermore, the bags are designed in a way that the inside of the bag is not visible and, thus, their contents are not visible to a consumer resulting in the consumer not being able to perceive that the tostadas in the majority of cases are broken.

SUMMARY OF THE INVENTION

By means of the container of the invention, the totality of the disadvantages described above disappear due to the security with which the container is opened and closed, as well as the ease in piling and packing of the containers. The container structure prevents the product from being broken and provides the ability to see the contents in the container and to take only the necessary pieces out of the container.

Mexican Utility Model Number 2203 has been earlier obtained. However, improvements with lots of advantages in the closing system have now been made. This results in an additional advantage which is described herein.

This new packaging container is octagonal and unique, especially within the tostadas market. The container has a new, easy, and practical closing system, totally uncommon, because through a series of folding sections located on the top side of the packaging, it is possible to protect and to keep tostadas fresher and crispier for a longer time.

Additionally, this new closing system does not require any type of adhesive, which is an advantage regarding cost of production.

Furthermore, this new closing system allows the formation of a flower design through folding of sections that appear on the top part, which provides a special attraction for the consumer because of the eye-catching attraction.

The container has, among other features, a window through which the consumer can appreciate the contents of the box. This window is big enough to allow the consumer an adequate observation of the condition of the tostadas, which differs from the packaging used today in the market which has a small window that does not allow a possible buyer to see in an appropriate way the contents of the package.

The container uses adhesive only on one side allowing easy and practical assembly of the container, as well as storage of the container.

It is thus an objective to provide a container for food, especially tostadas, having the following advantages:

(a) To open and close the container in an easy and practical way, as well as to take out in a secure manner a desired amount of product;

(b) Due to the flower design, the container has on a top part a special visual attraction for its commercialization;

(c) The "sinking" of the top part upon closure, provides a kind of "cushion", that protects the product and avoids broken pieces;

(d) Secure transportation from one place to another that safeguards the product from being broken or damaged;

(e) Tostadas are kept whole over a longer time period, due to the diameter and height of the container, which is designed especially for this purpose;

(f) To observe the state and condition of the tostadas; and (g) Due to its design and easy mounting, the container is more economic in its production process, which permits offering the consumers a better price in the final product.

BRIEF DESCRIPTION OF THE DRAWINGS

The particular details of the invention are clearly shown in the following description and the attached drawings. References which indicate different parts of the container are shown in the figures.

DETAILED DESCRIPTION OF THE PREFERRED EMBODIMENTS

Figure 1:
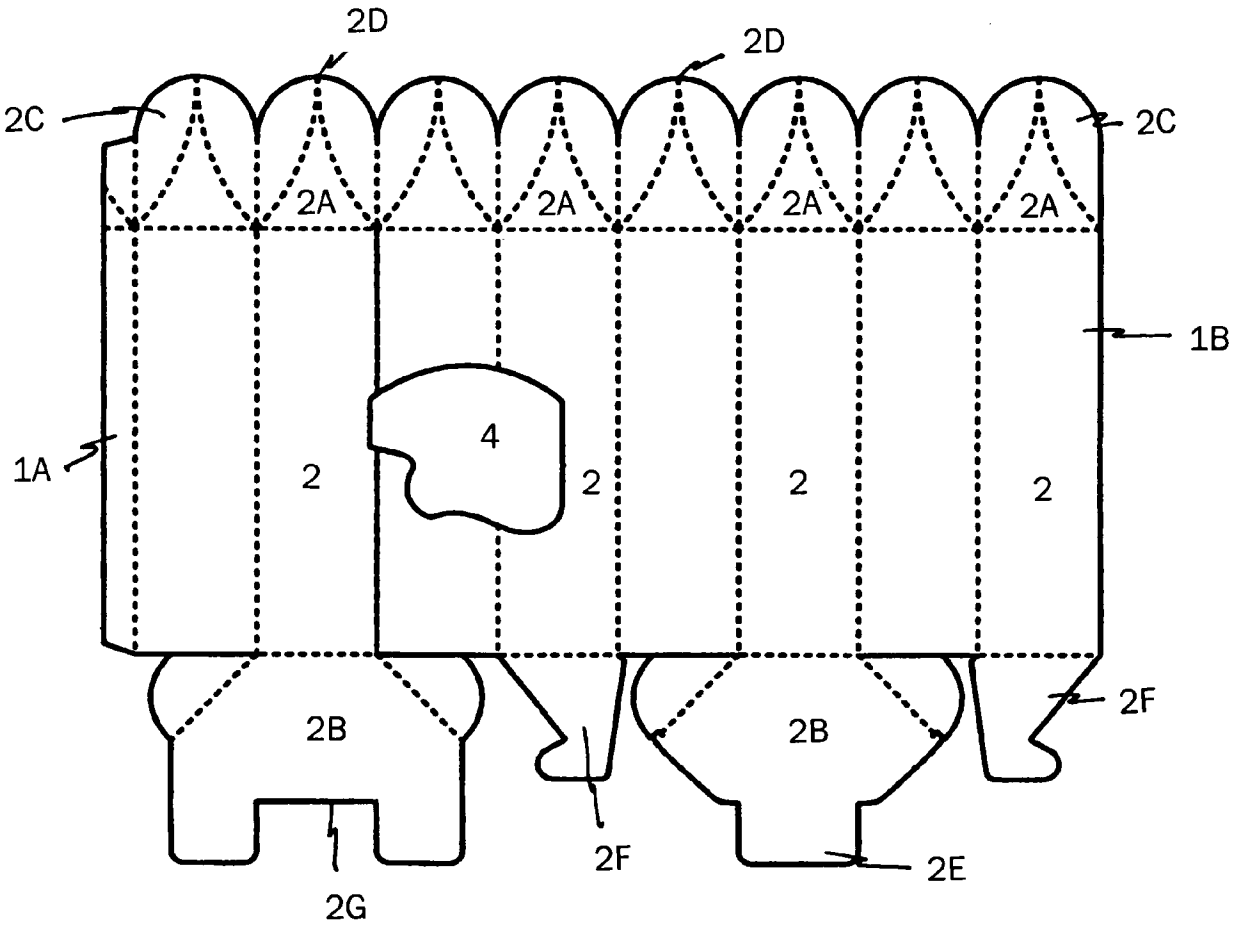
FIG. 1 shows a plan view of the container before it is assembled.
Figure 2:
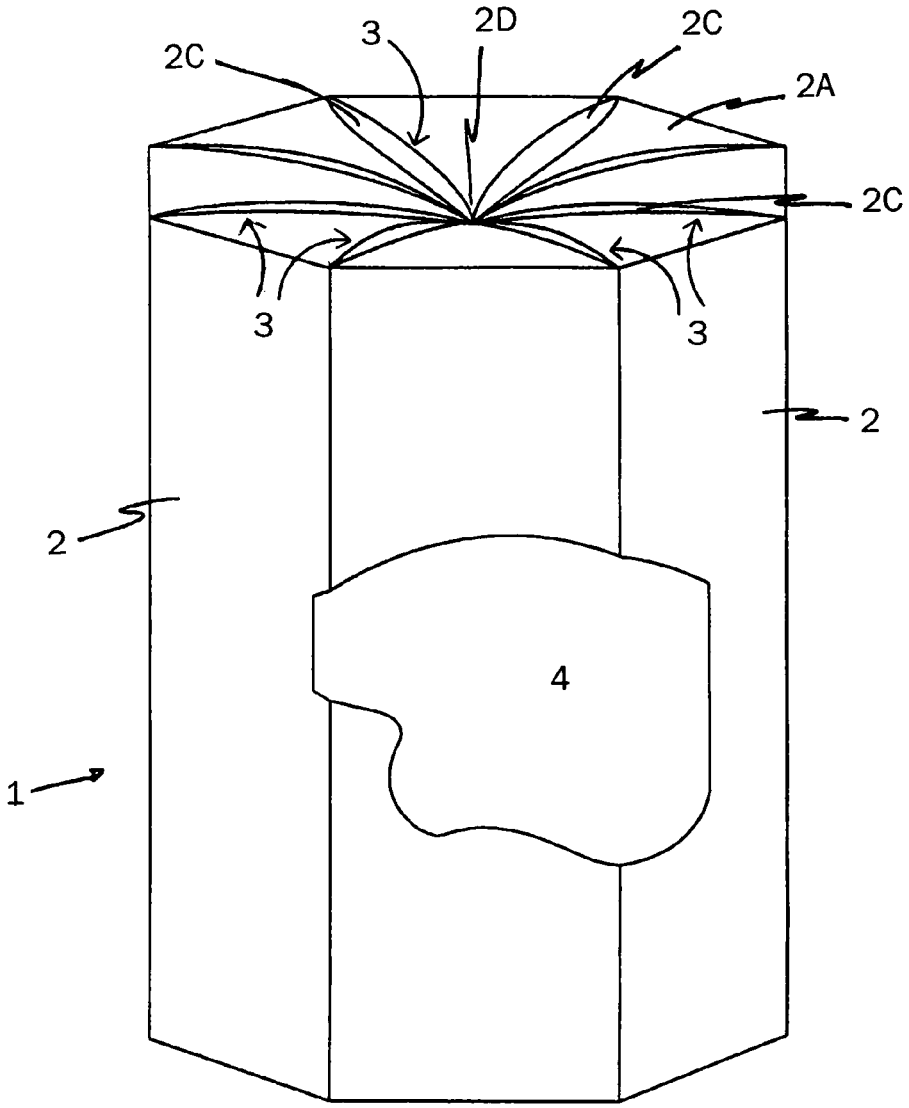
FIG. 2 shows a perspective view of the container in a closed state in which the flower design formed when it is closed is seen, as well as the window through which the product is observed.
Figure 3:
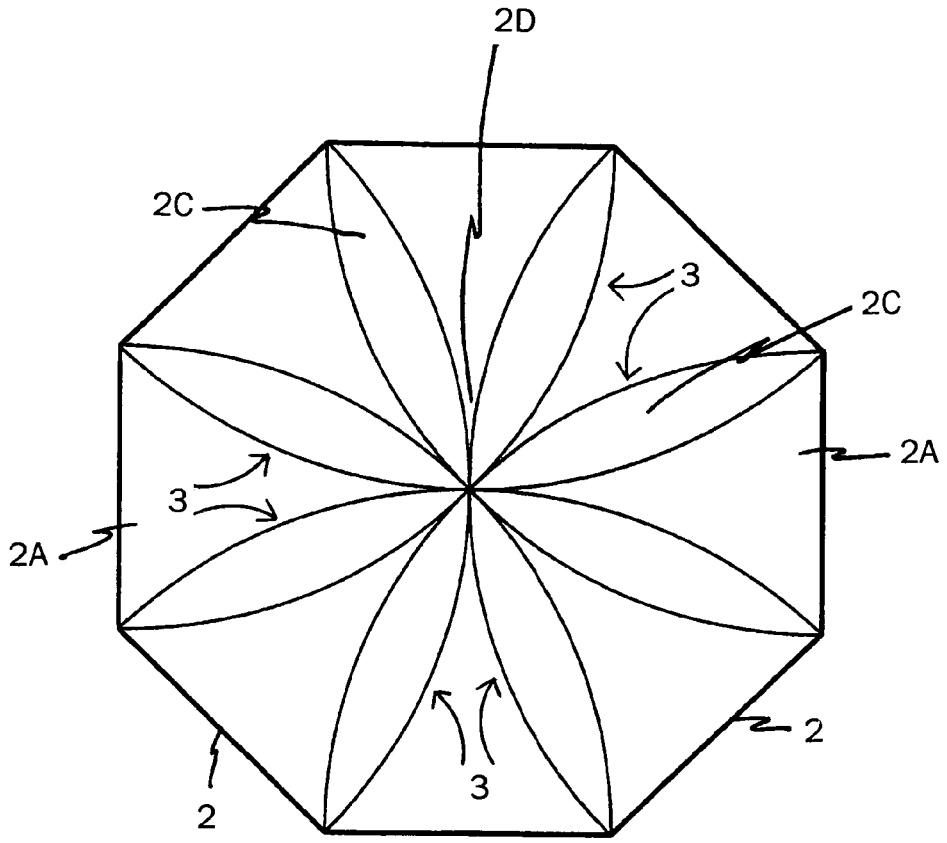
FIG. 3 shows a top plan view of the container already assembled in which the flower design formed when the container is closed is shown.
Figure 4:
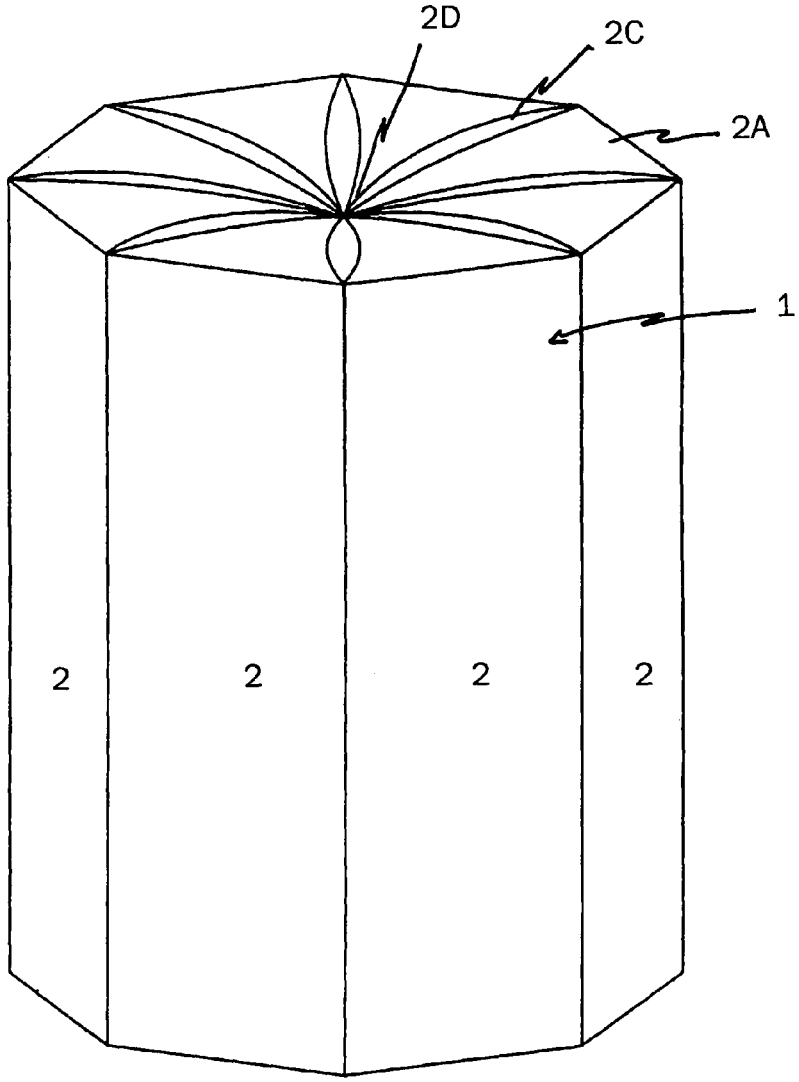
FIG. 4 shows an elevated back side perspective view of the container with the lid closed.
Figure 5:
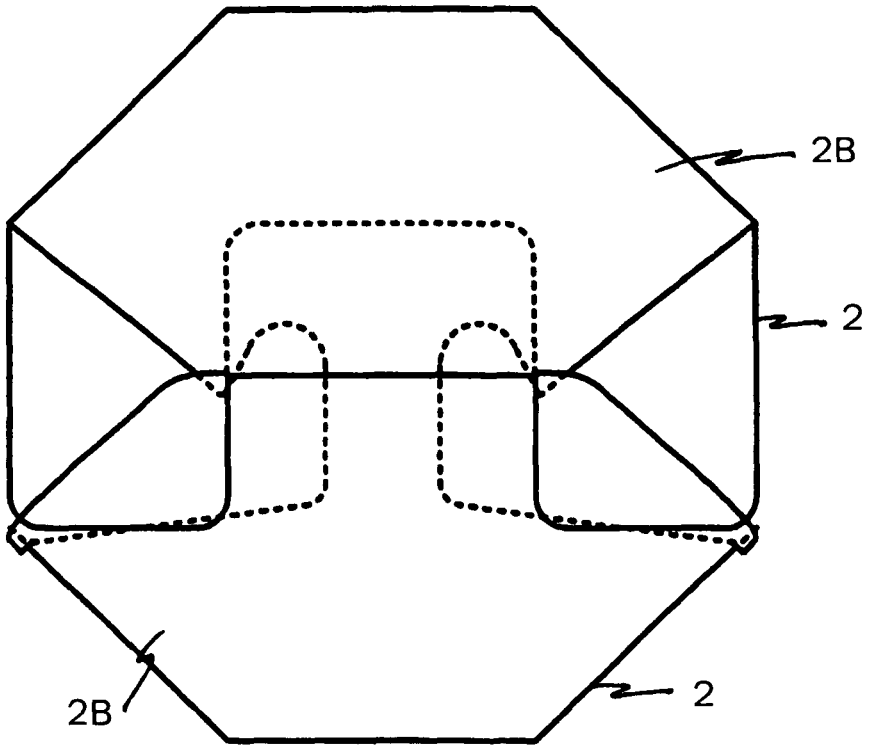
FIG. 5 shows a bottom view of a closed container showing the complete folds along dotted lines.
Figure 6:
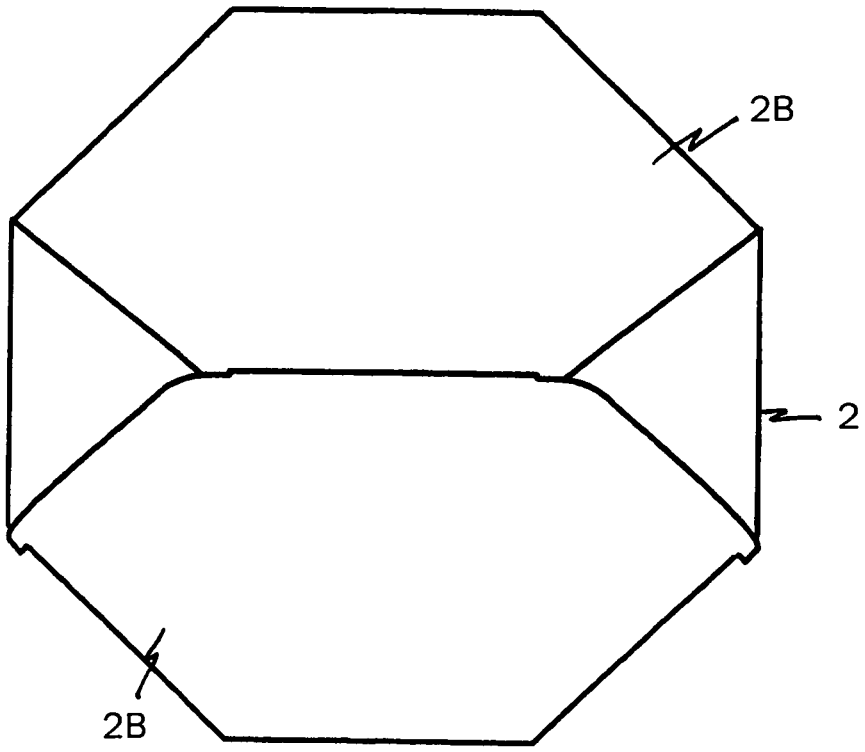
FIG. 6 shows a bottom view of a closed container.
Figure 7:
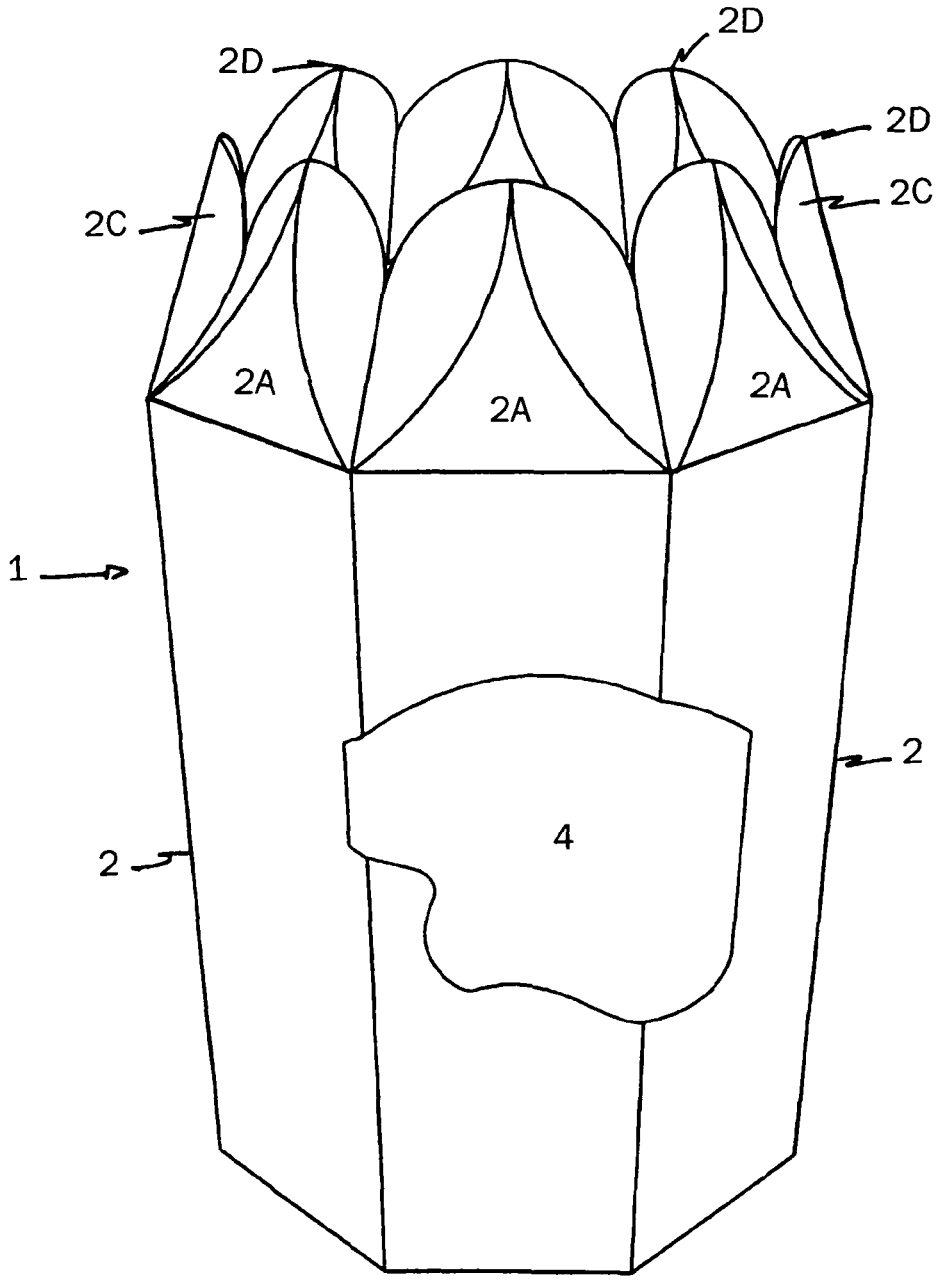
FIG. 7 shows an elevated front or face view of the container in an open state.

Referring to FIGS. 1-7, the container includes a carton based manufactured body (1), which is formed with eight sections or sides (2). The container is formed from the blank by joining a flap (1A) from one of the sections, with the section on the opposite side (1B), with glue or any other appropriate material.

The eight sections include as well on their topmost side (2A), with edges (2C), that through a series of folding actions are joined in the center forming a kind of flower (3), with which the container is closed without requiring any type of gluing. In order to open the container, it is only necessary to pull out the opening flaps (2D) providing a way to take out the product that is required. In order to close the container, it is only necessary to push the opening flaps (2D) downwards by which action the container is closed to keep the product in good condition.

When joining the edges (2C) of the top section (2A) in the container to close it, there is a "sinking", i.e., downward or inward motion (see FIGS. 2 and 4) as to the top of the container resulting in a downward positioning or angle of 2A, 2C and 2D. This "sinking" action serves as a cushion to allow the product within the container, such as the already mentioned tostadas, to be kept in a good condition.

Likewise, to form the bottom part of the container, flaps and edges (see FIGS. 1, 5 and 6) 2B, 2E, 2F are folded inwards in the container. Flaps 2C are folded inward followed by joining the edges (2B) by means of a flap (2E) introduced into a notch (2G).

Additionally, the container has in its middle area in two sides (2) an opening (4) that serves as a window. The window allows the consumer to observe the state or condition of the product within the container.

The container blank and, therefore the container, can be made of conventional packaging materials, e.g. cardboard or paperboard, which may be coated. The window or opening 4 can be covered by an appropriate plastic or cellophane sealing material.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A container for packaging food comprising an octagonal body formed from a carton blank having eight side sections, a first flap located at a first end of said carton blank adjacent one of said side sections, said first flap being attached by an adhesive to another one of said side sections located at a second end of said carton blank thereby forming the body of the container; a bottom wall formed from a plurality of flaps extending from a first end of the side sections of the blank and which includes at least a first flap which overlaps a second flap, said first flap being centrally joined to the second flap by a third flap extending from said first flap inserted into a notch present in said second flap; a top wall formed from a plurality of edge portions of uniform length extending from a second end of said side sections of the blank, each of said edge portions including a free outer edge wherein a portion of said outer edge is rounded, the rounded portion including a topmost point located farther from a respective one of said side sections than remaining portions of said outer edge and centered vertically with respect to sides of the respective side section, each of said edge portions being symmetrical about a line extending from said topmost point to said respective side section, said edge portions forming a reclosable top wall in the container by a series of folds in the edge portions which allow joining of the edge portions in a center of the top wall of the container, and which is kept in a closed position in the absence of an adhesive, wherein the edge portions are constructed and arranged to allow the top wall to be opened by a pull outwards of one edge portion of said plurality of edge portions and to be closed by pushing the edge portions to the center and inwards of the body so that when closed said top wall extends at least partially inward in the body; and an opening located in a middle portion of at least one of said side sections that acts as a window to provide visibility inside of the container.

2. The container of claim 1, wherein the edge portions are centrally joined so as to form a flower design when closed.

* * * * *